United States Patent [19]

Bengtsson et al.

[11] 4,016,630

[45] Apr. 12, 1977

[54] OVERLOAD PREVENTING DEVICES IN CRUSHERS

[75] Inventors: Berndt Harry Bengtsson, Lindome; Sten Anders Harald Bremmer, Arbra, both of Sweden

[73] Assignee: Svedala-Arbra AB, Sweden

[22] Filed: June 30, 1975

[21] Appl. No.: 591,623

[30] Foreign Application Priority Data

July 2, 1974 Sweden ..... 7408697

[52] U.S. Cl. ..... 241/207; 241/213

[51] Int. Cl.[2] ..... B02C 2/04

[58] Field of Search ..... 241/32, 37, 207–216

[56] References Cited

UNITED STATES PATENTS

| | | | |
|---|---|---|---|
| 3,133,707 | 5/1964 | Zimmerman | 241/213 X |
| 3,328,888 | 7/1967 | Gieschen et al. | 241/213 X |
| 3,481,548 | 12/1969 | Beisner et al. | 241/215 |
| 3,873,037 | 3/1975 | Decker et al. | 241/211 |

*Primary Examiner*—Roy Lake
*Assistant Examiner*—Howard N. Goldberg
*Attorney, Agent, or Firm*—Bucknam and Archer

[57] ABSTRACT

An overload preventing device in crushers of the type having a crushing chamber with a conical crushing surface and a crusher head with a conical crushing surface being eccentrically rotatable about a shaft of the crusher, is of a simple and reliable construction and continuously varies the nip formed between the crushing surfaces as a protection against the crusher being overloaded.

14 Claims, 3 Drawing Figures

OVERLOAD PREVENTING DEVICES IN CRUSHERS

Figure 1:
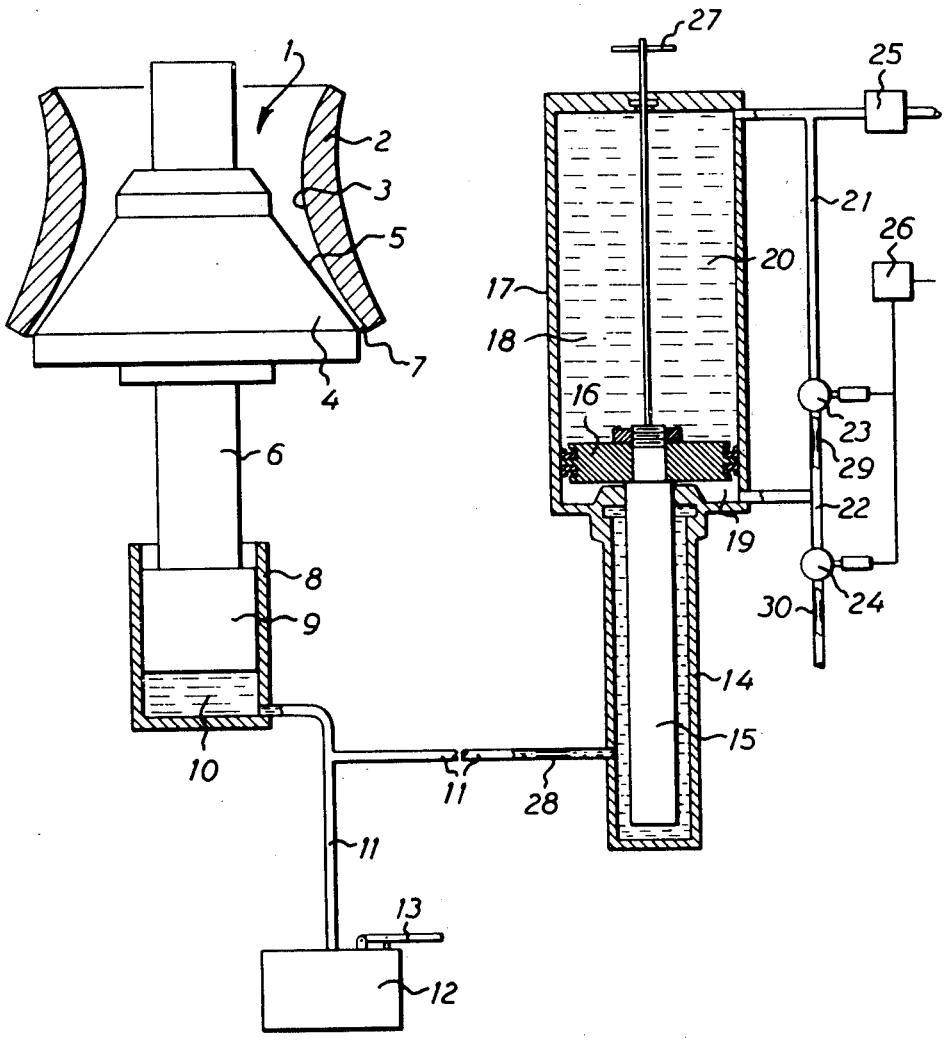

The invention relates to an overload preventing device in crushers of the type including a crushing chamber having a substantially conical crushing surface, and a crusher head located in the crushing chamber and preferably eccentrically rotatable about a shaft by a drive motor, said crusher head having a substantially conical crushing surface and being axially shiftable by means of an operating mechanism for varying the nip formed between the crushing surfaces of the crusher head and the crushing chamber.

The crusher head is shiftable in this way to permit setting of the crusher by widening or diminishing the nip, and it is previously known to equip the crusher with a device which during operation regulates the nip to thereby protect the crushing means should particles fed into the crusher or abnormally large particles accumulate in great numbers. The prior art overload preventing devices are very complicated and thus costly, and they do not permit a fully continuous adaptation of the nip to prevailing operating conditions.

The object of the present invention is to eliminate these problems by providing a relatively simple and fully reliable device for continuously adapting the nip as a protection against the crusher being overloaded.

According to the invention, said device comprises a first cylinder having a first piston which is adapted to be moved axially together with the crusher head and a second cylinder having a second piston which is movable by the action of a first pressure medium causing the two cylinders to communicate with one another, and by the action of a second pressure medium exerting on the second piston a load which is adjustable with the aid of control means. The first piston may be directly connected to the crusher head, in which case the crusher head is supported via the piston by the first pressure medium, as a rule hydraulic oil, the vertical position of said piston being thus determined by the level of the pressure medium in the second cylinder. The two cylinders are connected to one another so that the first pressure medium also acts on one side of the second piston.

The second pressure medium may be a compressible pressure medium, such as air, which acts on the other side of the second piston via the piston of a third cyclinder which is connected to a pressure source, such as an air compressor, and a pressure control system. In a particularly simple embodiment of the device according to the invention, however, said second pressure medium is a weight loading the piston of the second cylinder. This design makes for a far-reaching simplification over prior art safety devices in crushers of the type indicated, and it is a simple matter to regulate the weight, which can be done by adding and removing part weights.

The weight may be arranged to load not only the piston of the second cylinder, which is a hydraulic cylinder, but also the piston of a third cylinder which is a compressed air cylinder, said second cylinder being arranged as a stationary piston in the third cylinder in which case the third cylinder is movable relative to the second cylinder which serves as a piston.

In a further development of the invention a point of constriction is arranged in a pressure medium circuit between the first and the second cylinder, while a pressure medium buffer is provided between said point of constriction and the first cylinder.

Figure 2:
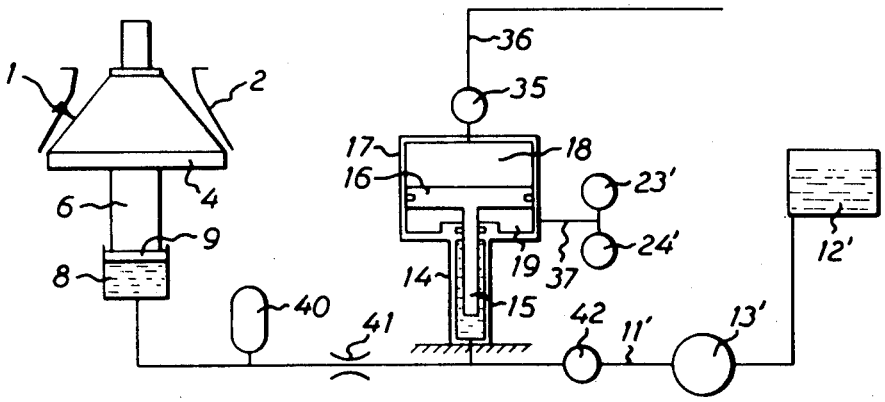
Figure 3:
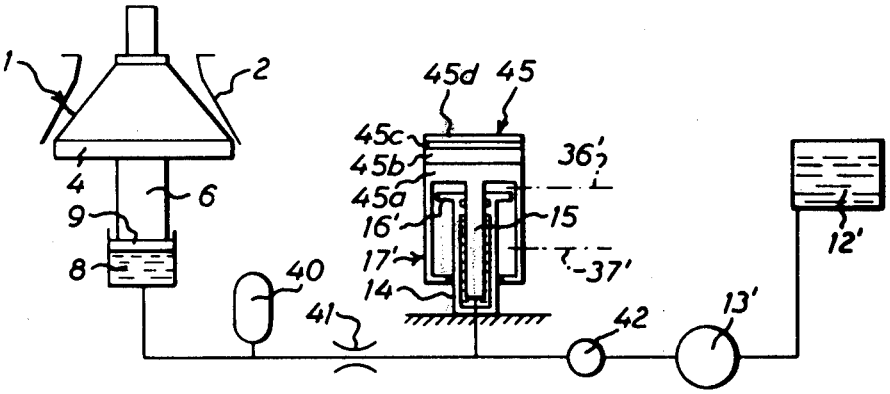

These and further characteristic features of the invention are described in greater detail hereinbelow and with reference to the accompanying drawings in which:

FIG. 1 is a diagrammatical vertical sectional view of part of a cone crusher equipped with an overload preventing device according to the invention;

FIG. 2 in a heavily diagrammatic form shows a modification of the device in FIG. 1; and FIG. 3 likewise in a heavily diagrammatic form shows a further modification of the device; owing to its great simplicity over the embodiments illustrated in FIGS. 1 and 2, said modification represents a preferred embodiment of the invention.

The crusher 1 diagrammatically shown in FIG. 1 comprises a crushing chamber 2 which has a substantially conical crushing surface 3, and a crusher head 4 having a substantially conical crushing surface 5. The crusher head 4 is located in the crushing chamber 2 and arranged to have imparted to it a gyratory movement about a shaft 6 by a drive motor (not shown). To permit variation of the nip 7 formed between the crushing surfaces 3, 5 of the crusher head and the crushing chamber the crusher head is movable axially together with a piston 9 which is movable in a first cylinder 8 by means of a pressure medium 10 in said cylinder 8. This pressure medium 10 is hereinafter referred to as "the first pressure medium". The chamber in the cylinder 8 beneath the piston 9 is in communication via a conduit 11 with a pressure medium container 12 having a pump 13 and with a second cylinder 14 which contains a movable piston 15. In the embodiment illustrated the piston 15 is rigidly connected to a further piston 16 which is movable in a third cylinder 17 by the action of the first pressure medium 10 which surrounds the piston 15 in the cylinder 14 and communicates with the cylinder 8. The two cylinders 14, 17 are sealed with respect to each other. In the embodiment illustrated the piston 16 is double-acting and divides the cylinder 17 into two chambers 18, 19 which can communicate with each other via a conduit 21. Further, one chamber 19 in the cylinder 17 communicates with the atmosphere via a conduit 22. Each of these conduits 21, 22 has a valve 23 and 24, respectively, by means of which the communication between the chamber 18 and the chamber 19 and the atmosphere, respectively, can be broken. The second pressure medium 20 which preferably is a compressible pressure medium, such as air, is in communication via a pressure regulator 25 with a pressure source (not shown).

The part of the overload preventing safety device as hitherto described, permits the crusher to operate at a constant load under relatively normal working conditions, but at a large overload of the crusher it may be necessary in certain cases to increase the nip 7 to a greater extent. Overloads on the crusher result in an increase of the feed current of the drive motor, and in the embodiment illustrated said current is sensed by sensing means 26 which is connected to the two valves 23, 24, said valves being preferably solenoid-operated valves, in the illustrated embodiment. Further, the piston assembly 15, 16 is provided with an indicating means 27 which extends beyond the cylinder assembly 14, 17 and indicates the position of the piston in the cylinder 14.

For setting the minimum nip 7 in the crusher 1 the first pressure medium 10 is pumped by means of the pump 13 from the pressure medium container 12 in a suitable volume and under a suitable pressure to the cylinders 8 and 14, while the second pressure medium 20 is introduced into the cylinder chamber 18 of the cylinder 17 at for instance such a pressure that the piston assembly 15, 16 in the idling state of the crusher is in its lower end position (shown in FIG. 1). At this time the valve 23 is closed and the valve 24 open. When thus the particles fed into the crusher 1 for crushing by their varying sizes or amounts in which they accumulate, produce an increased pressure force against the crusher head 4 said head can be moved against the action of an elastic yielding force by the piston 9 being moved in the cylinder 8, the first pressure medium 10 transmitting the pressure variations via the conduit 11 to the cylinder 14 for actuation of the piston 15 which can be urged upwards. A counter-force acts on the top of the piston 16 so that the movement of the piston assembly 15, 16 will be dependent upon the direction in which the resulting force acts, and owing to the compressibility of the pressure medium 20 a "resilient" counter-force will act on the piston assembly 15, which at an overload on the crusher tends to be moved upwards. At an extreme overload on the crusher the feed current for the drive motor of the crusher head 4 rises, which is sensed by the sensing means 26 which at a preset value of the feed current changes over the valves 23, 24. Under normal conditions the valve 24 is open while the valve 23 is closed, and at said overload the two valves are changed over so that the valve 24 is closed and the valve 23 is opened. This will cause said second pressure medium 20 to flow also into the cylinder chamber 19 and to co-operate with the first pressure medium 10, which results in the pistons 15, 16 being moved upwards and the nip 7 being thus enlarged beyond the normal variations of said nip. The load of the crusher drive motor immediately sinks as does the feed current sensed by the sensing means 26 which is adapted, when the feed current falls below a preset value, again to change over the valves 23, 24 so that the valve 23 is closed and the valve 24 is opened. In order that the nip shall not be altered at very brief and small load variations throttling means 28, 29, 30 are interposed in the conduits between the cylinders 9, 14 and on either side of the valve 24, said throttling means delaying the propagation of the pressure changes in the conduits.

For certain applications it may be sufficient to have the possibility of varying the nip 7; this is realized by means of the cylinder assembly 14, 17 without sensing the feed current of the drive motor, in which case the control device comprises only the pressure regulator 25 or some other suitable pressure regulating means, for instance of the kind utilized in compressors.

In the embodiment illustrated in FIG. 2, where the same reference numerals as in FIG. 1 are used for equivalent elements, the crusher comprises a crushing chamber 2 and a crusher head 4 gyrationally driven by an electric drive motor (not shown). The crusher head is supported by a piston 9 in a hydraulic cylinder 8 and is vertically adjustable by regulation of the level of the hydraulic oil in the cylinder 8 for setting the nip between the crushing chamber wall 2 and the crusher head 4. The cylinder 8 communicates with a second hydraulic cylinder 14 in that the latter cylinder is connected to the hydraulic system in which the first mentioned cylinder 8 is connected. Said hydraulic system comprises a source of hydraulic liquid 12′ and a circuit of conduits 11′ with a pump 13′.

The piston 15 of the cylinder 14 is connected to a piston 16 in a compressed air cylinder 17 and is movable together with said piston 16. The cylinder chamber 18 of the cylinder 17, which chamber is situated on the side of the piston 16 opposite to the cylinder 14, is connected via a pressure reduction or pressure control valve 35 by a conduit 36 to a suitable compressed air source (not shown), such as a compressor, and the other chamber 19 of the cylinder 17 is connected to a conduit 37 which can be connected to the pressure source and to the atmosphere via closable valves 23′, 24′.

The device described with reference to FIG. 2 gives a constant crusher load under relatively normal working conditions, and at great overloads permits a larger increase of the nip by connection of the compressed air conduit system to a suitable load sensing means (not shown). In the embodiment of FIG. 1 the valves 23, 24 may be solenoid-operated valves connected to the load sensing means 26 which senses the load on the crusher by sensing the current consumption of the crusher drive motor, but in an alternative the load sensing means can also, or instead, be arranged to sense the hydraulic pressure in the hydraulic system.

To set the crusher in FIG. 2 for the minimum nip, hydraulic liquid is pumped by the pump 13′ to the cylinder 8 for setting the piston 9, hydraulic liquid being also supplied to the cylinder 14 so as to actuate the piston 15 and thus the piston 16. The compressed air cylinder 17 is filled above the piston 16 with compressed air to desired pressure via the line 36 and the valve 35, and said pressure impresses via the piston 16 a counter-pressure on the piston 15. The pressure is so adapted that the piston 15 of the cylinder 14 in the idling position of the crusher is in a desired position, for instance in its lower end position. During operation the piston 9 of the cylinder 8 is actuated by the load on the crusher head 4 and, at increases of load, pressure liquid is displaced from the cylinder 8 to the cylinder 14 in that the piston 15 can be moved upwards in the cylinder 14 against the action of the pressure in the cylinder 17. The position of the piston 16 in the cylinder 17 is determined by the differential pressure on both sides of the piston, that is, on the one hand, the air pressure on the upper side of the piston 16 and, on the other hand, the pressure exerted by the piston 15 of the cylinder 14 at the underside of the piston 16 and possibly compressed air which may be introduced into the chamber 19 of the cylinder 17 to act against the underside of the piston 16.

The compressed air in the cylinder chamber 19 thus acts as a preloading "air spring" for the piston 9 in the cylinder 8 and can be adapted to any desired preloading degree about which the piston 9 actuated by the "air spring" can operate. Sudden heavy pressure changes in the hydraulic system can be accommodated by a pressure buffer 40 connected to the hydraulic system and by a point of constriction 41 provided between the cylinder 14 and the pressure buffer 40. Further, a pressure reduction or control valve 42 may be arranged between the pump 12′ and the hydraulic cylinders 8, 14.

The device according to the invention illustrated in FIG. 3 and operating on the same main principle can operate without the aid of a compressed air source and air spring, such as the air spring 16, 17 in FIGS. 1 and 2, but can readily be combined with these means, if desired.

Use is made in FIG. 3 of the same reference numerals as in FIG. 2 for corresponding elements, which need not therefore be described in detail. Instead of the air spring consisting of the compressed air cylinder 17 and its piston 16, use is made in the embodiments illustrated in FIG. 3 of a yielding load 45 in the form of one or more weights. The load should preferably permit being increased by adding weights 45*b*, 45*c*, 45*d*, to a basic weight 45*a*. These weights can constitute a suitable series of weights for the entire operating range of the crusher. The weight 45 constantly acts as a load on the hydraulic pressure via the piston 15 in the hydraulic cylinder 14. At an increase of the pressure the weight 45 is raised and at a reduction of the pressure the weight 45 is lowered.

As illustrated in FIG. 3 the basic weight 45*a* or the part on which the weight rests, may have the shape of a cylinder 17′, and the hydraulic cylinder 14 may be arranged as a piston 16′ in the cylinder 17′, in which case the piston 16′ and the cylinder 17′ can constitute an air spring having the same task as the air spring 16, 17 in FIGS. 1 and 2. Therefore, dash and dot lines in FIG. 3 indicate a pair of connecting lines 36′, 37′ which may have the same tasks as the lines 36, 37 in FIG. 2 and, like these lines, may be equipped with valves (not shown), such as the valves 35 and 23′, 24′, respectively, in FIG. 2.

The device illustrated in FIG. 3 can be regulated also without an air spring. It may for instance be equipped with sensing means (not shown) for sensing the crusher motor load or hydraulic pressure, or both, and these sensing means may be connected to a device (not shown) driven electrically or hydraulically for adding or removing weights 45*a*–45*d* for altering the preload 45 and for presetting the nip.

The device illustrated in FIG. 2 and that illustrated in FIG. 3 can easily be combined with means (not shown) for recording or indicating the position of the piston 15 and 16′, respectively, and thus for recording the position of the piston 9 in the cylinder 8. Like in the embodiment in FIG. 1, these means can include an indicating rod connected to the piston 15 and having a means (means 27 in FIG. 1) which externally shows or records the position of the piston 15 and thus the position of the piston 9.

What we claim and desire to secure by Letters Patent is:

1. A crusher comprising a crusher cone and a crushing liner defining a crusher nip therebetween, a substantially vertical pressure cylinder having an upper and a lower space, the crusher cone having a central supporting member extending into said upper space and being supported for axial movement in said upper space on pressure fluid contained therein, means connected to said lower space for controllably supplying thereto and discharging therefrom pressure fluid in dependence on the pressure exerted on the crusher cone by material to be crushed in said nip, whereby the elevation of the crusher cone and the width of the nip are adjusted; a damping means comprising a damping cylinder, a conduit having a constricted passage and providing a continuous communication for said pressure fluid between said lower space of the pressure cylinder and the damping cylinder, said damping means comprising first piston means movably mounted in said damping cylinder to interact with pressure fluid in said damping cylinder and thereby, through said constricted passage, with the pressure fluid in the pressure cylinder and thus with said central supporting member of the crusher cone, said damping means also comprising preloading means acting with a substantially constant pressure on said piston against the action of said pressure fluid both during normal operation and during overload thereof.

2. A crusher as claimed in claim 1, wherein said preloading means comprise a weight means acting upon the piston of the damping cylinder.

3. A crusher as claimed in claim 2, wherein said weight means comprises a number of removable part weights and said damping means comprises an adjusting means for adjusting said weight means, by removal of part weights.

4. A crusher as claimed in claim 3, said crusher comprising a motor for driving said crusher cone and wherein said damping means comprises sensing means connected to sense the current consumption of the crusher motor to permit stepwise adjusting of said weight means according to the motor load.

5. A crusher as claimed in claim 3, wherein said damping means comprises sensing means connected to sense the pressure of said pressure fluid to permit adjusting of said weight means according to said pressure and thereby to the crushing load.

6. A crusher as claim in claim 1, wherein said pressure fluid is a hydraulic pressure fluid, said damping cylinder is a first hydraulic cylinder and said pressure cylinder is a second hydraulic cylinder having a second piston therein, and wherein said preloading means of said damping means comprises a pneumatic cylinder having a third piston means connected to said first piston means of said first hydraulic cylinder to be movable therewith, and a controllable source of compressed gas connected to said pneumatic cylinder for forming a cushion of compressed gas acting on said third piston means in said pneumatic cylinder against the hydraulic pressure acting on the first piston means in the first hydraulic cylinder.

7. A crusher as claimed in claim 6, wherein said damping means comprises an adjusting means connected between said source of compressed air and said pneumatic cylinder and a sensing means connected to sense the crushing load on said crusher cone and to control said adjusting means in relation thereto.

8. A crusher as claimed in claim 6 wherein said preloading means comprises sensing means connected to sense the gas pressure in said pneumatic cylinder, and control means connected to said sensing means to be actuated thereby and connected to said pneumatic cylinder to regulate said gas pressure therein.

9. A crusher as claimed in claim 8, wherein said third piston means in said pneumatic cylinder comprises a piston which delimits in said pneumatic cylinder first and second chambers on opposite sides of the piston, said first chamber being a preloading cushion chamber, and wherein said control means comprises means to transmit compressed gas to said second chamber when the pressure in said cushion chamber rises over a predetermined value.

10. A crusher as claimed in claim 9, wherein said compressed gas transmitted to said second space in said pneumatic cylinder is compressed gas from said cushion chamber.

11. A crusher as claimed in claim 9, wherein said control means comprises connecting means connecting at least one of said pneumatic cylinder chambers to the atmosphere and valve means for adjustable opening and closing of said connecting means.

12. A crusher as claimed in claim 9, wherein said control means comprises two valves connected each to one of said cylinder chambers and wherein each of said valves is adapted to be opened when the other valve is closed, for connecting the respective cylinder chamber, according to the pressure therein, to said source of compressed gas or to the atmosphere.

13. A crusher as claimed in claims 8, wherein said third piston means in said pneumatic cylinder and said piston means in said first hydraulic cylinder are rigidly interconnected and have different diameters, the piston of the smallest diameter is the first piston means in the first hydraulic cylinder and the piston of the largest diameter is the third piston means in the pneumatic cylinder.

14. A crusher as claimed in claim 1, wherein a pressure medium buffer is disposed between said constricted passage and said lower space in said pressure cylinder.

* * * * *